United States Patent [19]

Andersson et al.

[11] Patent Number: 4,683,841

[45] Date of Patent: Aug. 4, 1987

[54] CONTROL OF A BLACK LIQUOR RECOVERY BOILER

[75] Inventors: Susanne Andersson, Enebyberg; Jan-Erik Gustafsson, Täby; Torbjörn Herngren, Älvsjö; Staffan Carlsson, Mönsterås, Gunnar Hage, Västerås, all of Sweden

[73] Assignees: Svenska Träforskningsinstitutet, Stockholm; Södra Skogsägarna AB—Mönsterås Bruk, Mönsterås; ASEA Aktiebolag, Västerås, all of Sweden

[21] Appl. No.: 836,559

[22] Filed: Mar. 6, 1986

[30] Foreign Application Priority Data

Mar. 8, 1985 [SE] Sweden ..... 8501137

[51] Int. Cl.[4] ..... F22B 31/04; D21C 11/12

[52] U.S. Cl. ..... 122/22; 110/238; 162/30.1

[58] Field of Search ..... 162/30.1, 31; 110/238; 122/7 R, 10, 22

[56] References Cited

U.S. PATENT DOCUMENTS

| | | | |
|---|---|---|---|
| 2,303,811 | 12/1942 | Badenhausen | 110/238 |
| 2,891,843 | 6/1959 | Moxness | 110/238 |
| 3,053,615 | 9/1962 | Steinert | 162/30.1 |
| 3,215,099 | 11/1965 | Coulter, Jr. | 110/238 |
| 3,421,462 | 1/1969 | Wessberg | 110/238 |
| 3,439,724 | 4/1969 | Mason | 162/30.1 |
| 3,574,051 | 4/1971 | Shah | 162/30.11 |
| 3,712,117 | 1/1973 | Fitzgerald et al. | 137/92 |
| 3,831,616 | 8/1974 | Weyers | 137/92 |
| 3,849,536 | 11/1974 | Morgan | 162/30.1 |
| 4,363,698 | 12/1982 | Nelson et al. | 162/30.1 |
| 4,420,008 | 12/1983 | Shu | 137/92 |
| 4,441,959 | 4/1984 | Empire, Jr. | 162/30.1 |
| 4,452,265 | 6/1984 | Lonnebring | 137/4 |
| 4,533,433 | 8/1985 | Pettersson | 162/30.1 |
| 4,627,458 | 12/1986 | Prasad | 137/13 |
| 4,628,329 | 12/1986 | Regnault | 137/92 |

*Primary Examiner*—Henry C. Yuen

*Attorney, Agent, or Firm*—Watson, Cole, Grindle & Watson

[57] ABSTRACT

A method for controlling the combustion and reduction processes in a black liquor (B.L.) boiler of a paper pulp plant by influencing the feeding of black liquor to the B.L. recovery boiler by means of a B.L. gun. Characteristic of the method is that the average thickness of the layer of the B.L. flow, immediately after the black liquor has left the B.L. gun, is controlled to have a desired magnitude. The thickness of the B.L. layer is obtained in the form of an indirect measure which is defined as the droplet index (=DIX) and is constituted by a relationship between the viscosity, the density and the feed rate of the black liquor and by at least the shape and the opening area, of the B.L. gun.

16 Claims, 4 Drawing Figures

CONTROL OF A BLACK LIQUOR RECOVERY BOILER

TECHNICAL FIELD

In pulp mills for the manufacture of chemical paper pulp, a black liquor (or B.L.) recovery boiler is normally included. Such a boiler is the most capital-demanding process unit in a pulp mill, which often means that the boiler determines the production. Therefore, it is of the utmost determines the production. Therefore, it is of the utmost importance that the B.L. recovery boiler has a high capacity and availability. This invention presents a method for, inter alia, maintaining stable conditions in the furnace so that a high efficiency can be maintained both in the combustion and the reduction stage and so as to prevent coatings on the heating surfaces which reduce the capacity and availability.

PRIOR ART, PROBLEMS TO BE SOLVED

In order, technically, to place the B.L. recovery boiler in its correct process perspective, the various functions in a paper mill for the manufacture of chemical paper pulp will now be described.

Chemical paper pulp is manufactured by treating limbs of trees, after debarking and comminuting into chips, in a boiling liquid at elevated temperature and at elevated pressure. During the course of this treatment, the so-called boiling process, the cellulose content of the wood is exposed and the lignin and other residual compounds in the wood are dissolved.

After the boiling process, the exposed cellulose fibers are separated from the dissolved lignin, the other wood residues and the chemicals used in a washing process. The dissolved wood substance, often constituting 50% of the original quantity of wood used, and the chemicals used are obtained in the form of a so-called weak liquor with a dry content of about 15%.

A considerable part of the water is removed from the weak liquor in an evaporation plant, whereby a so-called black liquor with a dry content normally exceeding 60% is obtained. It is this black liquor that is supplied as fuel to the B.L. recovery boiler, the operation of which is controlled by means of a method according to this invention.

In the B.L. recovery boiler, the wood substance of the black liquor is burnt and the energy it releases is conveyed away in the form of high-pressure steam. The steam generated is normally sufficient for meeting the entire steam demands of the pulp mill.

A regeneration of the chemicals contained in the black liquor is also performed in the B.L. recovery boiler. From the regenerated chemicals a new boiling liquid for the pulp manufacture is prepared. The handling of chemicals in the manufacture of chemical pulp thus constitutes a closed cycle in which the B.L. recovery boiler represents the central and most capital demanding process unit of the plant.

The B.L. recovery boiler consists of a combustion furnace with a steam boiler connected thereto. In order to convey an idea of the size of such a unit, it can be mentioned that a typical modern unit has a bottom surface of about 100 $m^2$ and a height of about 50 m. The walls of the furnace chamber are constituted by densely positioned steel tubes with a layer of thermal insulation lying outside the walls. The bottom of the furnace chamber is also covered with closely-packed tubes. The tubess are connected to the water and steam headers of a steam boiler and thus can extract heat from the furnace chamber. Black liquor is injected into the furnace chamber through so-called B.L. guns mounted in openings in the walls of the furnace chamber.

Combustion air is injected into the furnace chamber through ports around the periphery of the furnace, normally at three different levels. After the furnace chamber has been preheated (in any of a variety of different known ways) the combustion process can be started and will then be self-sustaining with the aid of the combustion air supplied, whereby the organic substances in the black liquor are burnt radiating heat to the tube-defined walls of the furnace chamber. The combustion gases pass up through the furnace chamber and in flowing past the tube system of the boiler give up heat to the feed water in the tubes. This will then boil and generate steam.

The inorganic chemicals in the black liquor will melt and collect in a bed on the bottom of the furnace. The bed consists of inorganic chemicals and a carbon "skeleton" originating from the organic content of the black liquor. The regeneration of the chemicals means, among other things, that the sulfur present is reduced. The regenerated chemicals are passed, in the form of a melt, through channels out from the furnace.

Thus, the B.L. recovery boiler forms part of a reactor, in which both an oxidation process and a reduction process are required to take place. The two processes are not separated from each other by the design of the plant so that attempts must be made to run the B.L. recovery boiler such that the supply of black liquor and air takes place in such a way that reducing conditions can be maintained in the lower part of the furnace chamber, while at the same time oxidizing processes can take place at a somewhat higher level. The reduction efficiency, that is, how large a proportion of the outgoing sulfur is reduced, is of great importance for the operating economy, etc., of the pulp mill. Furthermore, achieving a high combustion efficiency is most important for the energy balance of the mill.

The black liquor is normally supplied through burner means and these can be of various kinds. These burners are commonly referred to as "B.L. guns" and often open out into simple nozzles provided with some form of spreader plate or "lip". The B.L. guns are often formed so as to be movable both in vertical and in horizontal directions.

The normal procedure when controlling the supply of black liquor to the furnace is that the pressure in the line, immediately upstream of the nozzle, is measured and is allowed to influence a valve downstream of the black liquor pump so that the pressure is held constant.

Another and more advanced variant which is utilized in certain computerized control systems is to control the flow of black liquor on the basis of a measurement of the dry content of the black liquor. Such a measurement is normally performed by a refractive index meter or by a gamma radiation attenuation meter. The measurement is utilized as a measure of the contents of dry substance in the black liquor and is allowed to influence the flow-controlling valve so that a predetermined weight of dry substance per unit time is supplied to the B.L. recovery boiler. In this way a certain improvement of the stabilization of the reaction processes occurring in the furnace chamber is obtained. In this connection, reference is made to: Chamberlain, Lofkrantz, Smith: Computer Control of Recovery Furnace Smelt Reduction, Fouling and Corrosion, CPPA 1983, Process Control Symposium.

In a further variant, which is also employed in computerized control systems, the temperature of the black liquor is adjusted having regard to the dry content of the black liquor, the B.L. temperature being adjusted upwards or downwards in relation to the variation of the dry content. (Reference: Livonen—Computer Control in the Recovery Area of the Kraft Process, TAPPI, vol. 61, No. 11, pages 57-61.)

The properties of the black liquor, such as viscosity, density, temperature, chemical contents, dry content, and so on, influence the function and efficiency of the B.L. recovery boiler to a considerable extent. These properties often also vary considerably. This means that the reactions in the furnace chamber are subjected to considerable disturbances, which may lead to considerable problems in maintaining a good economy and availability. The sources of disturbance may be the following:

The heating value and the amount of organic substance in the black liquor vary as a result of varying raw materials and conditions in the pulp manufacture.

The contents of chemicals in the black liquor vary with variations in the pulp manufacture.

The volume of water in the black liquor also varies as a result of operating variations in the pulp manufacture and above all as a result of operating variations in the evaporation plant.

Considerable quantities of dust are formed in the furnace and accompany the flue gases up through the boiler. Normally, the greater part of the dust is recovered in electro-filters and can then be fed back to the black liquor. This means that the chemical content of the black liquor varies because of variations in the dust quantity being returned from the electrofilters.

Taken together, this means that the properties of the black liquor vary both with regard to the heating value of the black liquor and to its rheological properities. The variations in heating value directly influence the combustion process and indirectly influence the reduction process, since the reduction processes are heavily influenced by the temperature in the furnace chamber. The rheological properties, that is, inter alia, the viscosity and the density, in their turn greatly influence the distribution of the black liquor in the furnace chamber. In this way, the drying of the black liquor, the pyrolysis of the organic contents of the black liquor, and the combustion of the black liquor are also influenced. If the distribution of the black liquor in the furnace is too seriously disturbed, it is possible for B.L. particles to accompany the flue gases and cause significant coatings on heat exchange surfaces and thus limit the transmission of heat, which may result in the plant having to be closed down for cleaning.

The examples given of the state of the art for maintaining a good operation of the B.L. recovery boiler are typical of attempts to reduce the problems described. Existing solutions often involve a suboptimization of the recovery process in such a way that they improve the operation or reduce the effect of certain parameter variations but have no effect on other types of property variations. The method involving measurement of the dry content of the B.L., for example, does not take into account that the contents of organic and inorganic materials in the black liquor vary. Nor does this method take into account that the rheological properties of two samples of black liquor having the same dry content may be quite different.

As will have been clear from the description of the prior art in connection with the operation of B.L. recovery boilers, there are still considerable problems, from the point of view of process technique, in maintaining a stable and satisfactory operation with regard to efficiency, combustion and reduction. According to the present invention, a method for obtaining a control parameter for the operation of the B.L. recovery boiler is suggested, by means of which the consequences of varying B.L. properties can be reduced.

As has been indicated above now the black liquor is fed into and thus distributed in the furnace chamber, is very important for optimizing the various processes and reactions inside the furnace. Besides, by the properties of the black liquor itself, the spreading is also influenced by the shape of the B.L. gun and by the length of the lip of the B.L. gun. The black liquor, at a certain distance away from the lip of the B.L. gun, changes into droplets, and it is very important that the droplet formation be constant and independent of variations in the properties of the black liquor. Studies have shown that there is a relationship between the thickness of the B.L. layer immediately after the black liquor has left the lip of the B.L. gun and the formation of the droplets. It is true that the thickness of the black liquor varies somewhat around the periphery of the lip; however, it has been found that if the average thickness of the B.L. layer, immediately after the black liquor has left the lip, can be maintained at a certain constant value independent of the variations in the properties of the black liquor, then a constant and satisfactory formation of droplets is obtained and therefore also the most favorable conditions for a disturbance-free operation of the B.L. recovery boiler.

SUMMARY OF THE INVENTION

Thus, according to this invention, there is provided a method for controlling the combustion and reduction processes occurring in a black liquor (B.L.) recovery boiler by influencing the feeding of the black liquor to the B.L. recovery boiler by means of a B.L. gun, wherein means is provided to derive a value for the average thickness of the B.L. layer immediately downstream of the B.L. gun and the derived thickness value is controlled to at least approximate to a desired magnitude for the thickness.

Unfortunately, there is at present no practical way of undertaking a direct measurement of the thickness of the layer of B.L. and how it varies around the lip of the B.L. gun. Thus, it is not possible to obtain a measure of the average thickness of the B.L. layer immediately after the black liquor has left the lip. However, theoretical and empirical studies of the flow and distribution of the black liquor on the lip have indicated that an indirect measure of the average thickness of the B.L. layer can be obtained. How this measure varies with the properties of the black liquor and the shape and dimension of the B.L. gun should also be predictable. This measure is defined as the "droplet index" (=DIX) and in preferred methods according to the invention constitutes the value actually used in a closed-loop droplet index control system.

As indicated above, a B.L. gun often opens into simple nozzles provided with some form of spreader plate or lip. Other embodiments also exist. In the same way as it is possible to define a DIX value in the case of a B.L.

gun design with a lip, for other design solutions a DIX value can also be defined which indicates the average thickness of the B.L. layer immediately after the black liquor has left the B.L. gun.

In order to attain a desired DIX value, one or more of the B.L. properties in question, for example viscosity, temperature, etc., can be influenced. Thus, the invention aims to provide a well-defined and constant droplet size. The advantage of this is that the possibilities of keeping different zones (such as a drying zone, a pyrolysis zone, a reduction zone and a final combustion zone) separated from each other are considerably increased.

BRIEF DESCRIPTION OF THE DRAWINGS

The method of the invention will now be further described, by way of example, with reference to the accompanying drawings, in which.

DESCRIPTION OF PREFERRED EMBODIMENTS

An essential feature in the method of this invention is the method for obtaining the DIX value. Specific of the invention is that this value is employed as the actual value in a closed-loop DIX control. A few alternative ways of constructing the DIX control system will be described below together with a preferred embodiment.

Figure 1:
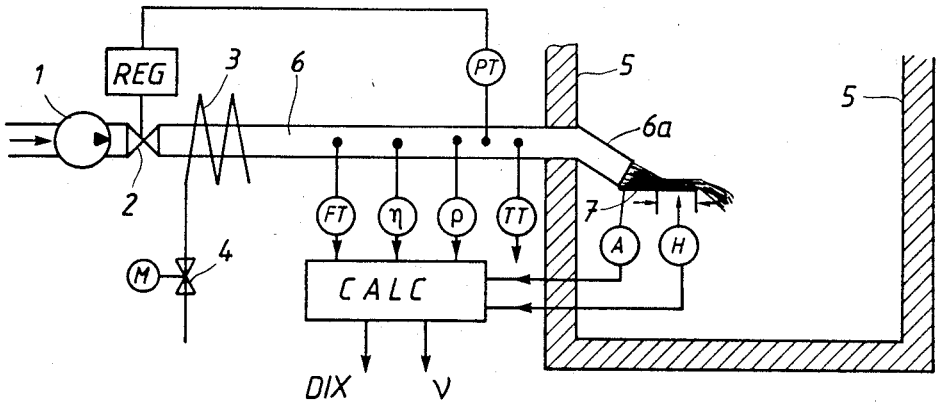
FIG. 1 shows, purely schematically, black liquor being supplied to a B.L. recovery boiler and the measurements of the properties of the black liquor that are needed for operating a method according to the invention.

FIG. 1 shows how a B.L. pump 1 drives black liquor to a furnace 5 via a conduit 6 and a B.L. gun 6*a*. The pressure (PT) in the conduit 6 immediately upstream of the gun 6*a* is controlled by a regulator REG acting on an associated valve 2, which forms part of the prior art control method, as mentioned before. The temperature of the black liquor can be influenced via a steam coil 3 and a control valve 4 therefor. The black liquor is supplied to the furnace 5 via the B.L. gun 6*a* which has a spreader plate or lip 7.

It has been indicated above that the droplet index (DIX) value is built up of the physical property parameters of the black liquor and the shape and dimension parameters of the B.L. gun 6*a*. The quantities included in the assessment of the DIX value are measured in a conventional way by means of transducers of various kinds which deliver suitable electrical signals for further processing. As will be clear from FIG. 1, the B.L. flow rate is obtained by means of a transducer FT, the dynamic viscosity of the black liquor by means of a transducer $\eta$ and the density of the black liquor by means of a transducer $\rho$. Also the opening area A of the B.L. gun 6*a* and a characteristic measure H of the spreader plate 7 are available in the form of electrical signals. For control purposes which will be described below, the temperature of the black liquor is assessed by means of a transducer TT, and finally also the kinematic viscosity $\nu$ of the black liquor is available which, as is well-known, can be written as $\eta/\rho$.

The spreader plate 7 normally has an almost circular shape. A center of the plate can be located where the center line of the B.L. gun 6*a* contacts the plate. The measure H constitutes the average distance from the defined center out to the periphery of the plate 7.

The previously stated indirect measure of the droplet index DIX of the average thickness of the B.L. layer immediately after the black liquor has left the spreader plate 7 of the B.L. gun 6*a* can be expressed as $$DIX = k_1 \frac{A}{H} + k_2 \left( \frac{\nu \cdot H}{v_0} \right)^{\frac{1}{2}} = k_1 \frac{A}{H} + k_2 \left( \frac{\eta}{\rho} \cdot \frac{A}{FT} \cdot H \right)^{\frac{1}{2}}$$

In addition to the previously stated quantities, the initial velocity $v_0 = FT/A$ (m/s) of the black liquor and the constants $k_1$ and $k_2$ are used in the equation: $k_1 = 1/\alpha$, where $\alpha$ is the scattering angle of the black liquor in radians on the spreader plate 7 in the plane of the plate. $k_2 = \beta/\sqrt{3}$, where $\beta$ is a constant which, based on boundary layer theory, indicates the dependency of the B.L. layer on the viscosity of the black liquor and where $\sqrt{3}$ implies that an imaginary rotary-symmetrical design has been assumed for the B.L. gun 6*a*.

Figure 2:
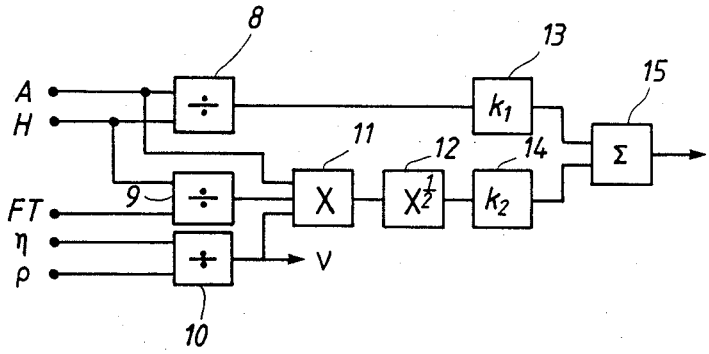
FIG. 2 shows how the CALC unit in FIG. 1 can be used to obtain a value of the quantity to be controlled.

The calculations which have to be carried out to deduce a value for DIX from the sensed parameters are carried out in a calculation element CALC in FIG. 1 and are extremely simple operations, as will have been clear from the equation noted above, and may be carried out in analog format or digitally. FIG. 2 shows one example of how the calculation can be carried out. It comprises means for division, 8, 9 and 10, means for multiplication, 11, 13 and 14, means for forming a square root, 12, and means for addition, 15.

For a given B.L. gun 6*a*, with a fixed opening area A and a lip length H, the DIX expression can be further simplified. Assuming $$a = k_1 \frac{A_0}{H_0} \text{ and } b = k_2 \left( \frac{H_0}{A_0} \right)^{\frac{1}{2}}$$

the following is obtained $$DIX = a + b \left( \frac{\eta}{\rho \cdot FT} \right)^{\frac{1}{2}}$$

which further simplifies the calculating operation.

Having calculated a desired value for DIX and an actual value of DIX in the manner described, a closed-loop control system for maintaining a constant thickness of the B.L. layer can be formed in many different ways. The desired value for DIX is set having regard to the operating conditions, primarily with regard to the B.L. quantity supplied and the B.L. flow, by the operator of the B.L. recovery boiler or by means of an overriding control.

Figure 3:
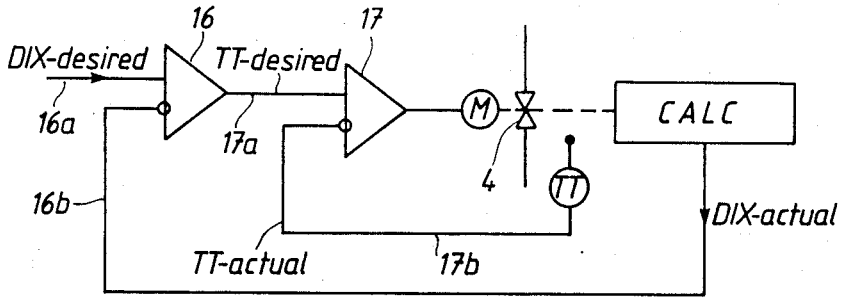
FIG. 3 shows a first embodiment of closed-loop control system for use in the method according to the invention having an internal closed-loop temperature control.

One way of influencing the black liquor so that the DIX value can be kept constant, is to modify the temperature of the black liquor. This can suitably be done by controlling the steam supply to the B.L. heater coil 3 via the valve 4 as shown in FIG. 1. It may then be convenient to work this method in the form of an internal closed-loop temperature control. A diagram showing the principle of such a control is shown in FIG. 3. In FIG. 3, a DIX regulator 16 is fed with a desired DIX signal (on input 16*a*) and an actual DIX signal (on subtracting input 16*b*). The output signal from the DIX regulator 16 then constitutes, in a known manner, the desired value of the internal closed-loop temperature control which is fed to one input (17*a*) of a temperature regulator 17. The actual temperature value is fed on subtracting input 17*b* and is obtained from the transducer TT. The output signal from the temperature regulator 17 can control, in a suitable manner, the supply of heat to the black liquor via the steam valve 4. The regulators 16, 17, may suitably be of PI (Proportional-Integral) or PID (Proportional-Integral-Derivative) types and may operate in analog or digital modes with corresponding PI or PID algorithms.

As in control systems in general, it is also possible to achieve improved performance as regards stability and dynamic and static accuracy as well as rapidity in eliminating disturbances without hunting by a suitable choice of internal feedbacks.

Figure 4:
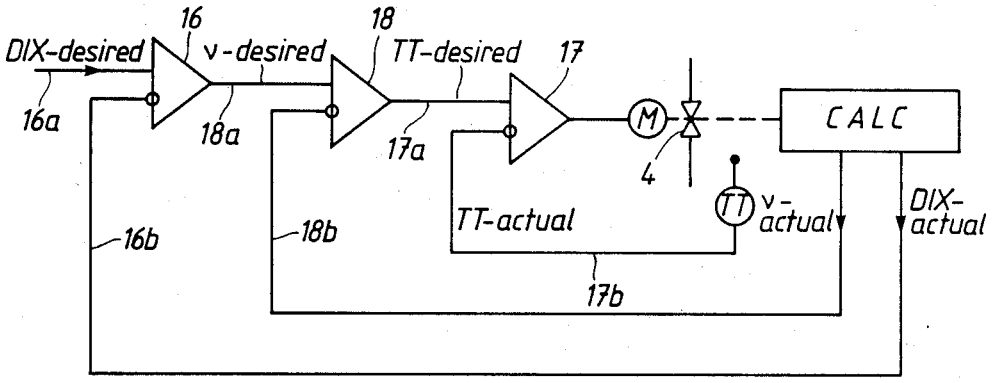
FIG. 4 shows a second embodiment of closed-loop control system for use in the method according to the invention having, on the one hand, an internal closed-loop viscosity control and, on the other hand, an internal closed-loop temperature control.

The control system which, at present, is considered to give the best performance is that shown in FIG. 4. In addition to the control systems already discussed with reference to FIG. 3, the system of FIG. 4 also includes an internal closed-loop viscosity control by means of a viscosity regulator 18. The desired viscosity value appears on input 18*a* to regulator 18 and the actual value of the kinematic viscosity of the black liquor is obtained in the manner shown via the calculating element CALC in FIG. 1 and in accordance with FIG. 2 and is fed to the regulator 18 on the subtracting input 18*b*.

In the examples shown, the DIX value has been modified by controlling the temperature of the black liquor. Additional alternative ways of influencing the DIX value may be

- by changing the geometry of the B.L. gun 6*a*,
- by changing the velocity of the black liquor, for example by influencing the pressure or the B.L. flow rate,
- by supplying a viscosity-reducing agent to the black liquor,
- by changing the angle of the B.L. gun 6*a* relative to the furnace wall,
- by recovering dust from the combustion gases and controlling the rate of return of dust to the B.L.

and

- by intermixing first and second streams of black liquor having at least one of different temperatures, different viscosities, different dry contents, and different distributions between organic/inorganic materials.

The invention is not to be considered as being limited to the specific arrangements set out above since many modifications thereto are clearly possible within the scope of the following claims.

We claim:

1. A method for controlling the combustion and reduction processes occurring in a black liquor (B.L.) recovery boiler by influencing the feeding of the black liquor in a layer form into the B.L. recovery boiler by means of a B.L. gun, said B.L. gun includes a lip which has a certain shape and length and which provides an opening area for said B.L. gun, said method including the steps of (1) determining a value for the average thickness of the B.L. layer immediately downstream of the B.L. gun, by sensing the viscosity, the density and the flow rate of the black liquor upstream of the B.L. gun and comparing these values with the shape, the opening area and the length of the lip of said B.L. gun, and (2) controlling the thickness value of the B.L. layer so that it approximates a desired value.

2. A method according to claim 1, wherein step (1) includes the step of determining a droplet index (DIX) according to the equation:

$$DIX = k_1 \frac{A}{H} + k_2 \left( \frac{\nu \cdot H}{v_0} \right)^{\frac{1}{2}} = k_1 \frac{A}{H} + k_2 \left( \frac{\eta}{\rho} \cdot \frac{A}{FT} \cdot H \right)^{\frac{1}{2}}$$

where $k_1$ = a constant dependent on the scattering angle of the black liquor in radians on the lip of the B.L. gun in the plane of the lip, A = the opening area of the B.L. gun, H = an average radius on the lip of the B.L. gun starting from a center located where the center line of the B.L. gun contacts the lip, $k_2$ = a constant dependent, on the one hand, on the dependence of the B.L. layer on the viscosity of black liquor and, on the other hand, on the geometry of the B.L. gun, $\nu$ = the kinematic viscosity of the black liquor, $\eta$ = the dynamic viscosity of the black liquor, $\rho$ = the density of the black liquor, $v_0$ = the feeding speed of the black liquor, and FT = the B.L. flow rate.

3. A method according to claim 2, wherein step (2) is accomplished by modifying the temperature of the black liquor.

4. A method according to claim 2, wherein step (1) is accomplished using an internal closed-loop control circuit which monitors B.L. temperature.

5. A method according to claim 2, wherein step (1) is accomplished using an internal closed-loop control circuit which monitors B.L. viscosity.

6. A method according to claim 4, wherein step (2) is accomplished by controlling B.L. viscosity.

7. A method according to claim 2, wherein step (2) is accomplished by changing the geometry of the B.L. gun.

8. A method according to claim 2, wherein step (2) is accomplished by changing the flow speed of the black liquor fed to the B.L. gun by influencing the pressure in a supply conduit for black liquor fed to the B.L. gun.

9. A method according to claim 2, wherein step (2) is accomplished by changing the speed of the black liquor flowing in a conduit leading to the B.L. gun.

10. A method according to claim 2, wherein step (2) is accomplished by modifying the viscosity of the black liquor.

11. A method according to claim 2, wherein the B.L. gun is located adjacent to a wall of the B.L. recovery boiler, and wherein step (2) is accomplished by changing the angle of the B.L. gun in relation to said wall.

12. A method according to claim 2, wherein step (2) is accomplished by recovering dust from the combustion gas of the B.L. recovery boiler and varying the proportion of dust returned to the B.L. flow upstream of the B.L. gun.

13. A method according to claim 2, wherein first and second black liquor streams of different viscosities are mixed prior to passage through said B.L. gun, and wherein step (2) is accomplished by varying the relative proportions of said first and second streams mixed together.

14. A method according to claim 2, wherein first and second black liquor streams of different temperatures are mixed prior to passage through said B.L. gun, and wherein step (2) is accomplished by varying the relative proportions of said first and second streams mixed together.

15. A method according to claim 2, wherein first and second black liquor streams of different dry substance contents are mixed prior to passage through said B.L. gun, and wherein step (2) is accomplished by varying the relative proportions of said first and second streams mixed together.

16. A method according to claim 2, wherein first and second black liquor streams with different ratios of organic/inorganic materials are mixed prior to passage through said B.L. gun, and wherein step (2) is accomplished by varying the relative proportions of said first and second streams mixed together.

* * * * *